United States Patent [19]

Uchizono et al.

[11] 4,048,936

[45] Sept. 20, 1977

[54] APPARATUS AND METHOD FOR SELECTIVELY SUPPORTING, CONVEYING AND MOUNTING A PROPELLER AND RUDDER

[75] Inventors: Kazuhiro Uchizono; Kentaro Yamada, both of Tsu; Kenji Saito, Hisai; Takato Taninaka; Yoshinari Abe, both of Tsu; Masayoshi Ishii, Gifu; Hiroo Nakayama, Mie; Sachio Futatsuki, Machida, all of Japan

[73] Assignees: Nippon Kokan Kabushiki Kaisha; Kayaba Kogyo Kabushiki Kaisha; Nihon Koki Kabushi Kaisha, all of Tokyo, Japan

[21] Appl. No.: 693,907

[22] Filed: June 8, 1976

[30] Foreign Application Priority Data

June 11, 1975 Japan ..... 50-70578

[51] Int. Cl.[2] ..... B63B 3/00

[52] U.S. Cl. ..... 114/65 R; 114/165; 180/8 C; 214/1 D; 254/84

[58] Field of Search ..... 114/65 R, 165, 162, 114/.5 R, 270; 29/234; 214/1 D; 254/84; 180/8 C

[56] References Cited

U.S. PATENT DOCUMENTS

| | | | |
|---|---|---|---|
| 2,660,253 | 11/1953 | Davidson | 180/8 C |
| 3,796,276 | 3/1974 | Maeda | 254/84 X |

FOREIGN PATENT DOCUMENTS

| | | | |
|---|---|---|---|
| 2,459,987 | 10/1975 | Germany | 114/65 R |
| 182,001 | 12/1962 | Sweden | 214/1D |

*Primary Examiner*—Stephen G. Kunin
*Assistant Examiner*—Sherman D. Basinger

[57] ABSTRACT

An apparatus and method wherein a pair of frame members each having four jacks and placed one upon another are provided with other jacks which are horizontally movable to change the relative position of the frame members, and the jacks are suitably operable sequentially to provide the frame members with a capacity to be moved freely within a dock, whereby a propeller or rudder for a large ship is held between a pair of scaffolds provided on the frame members and the article is then conveyed to the desired place and mounted in the desired position of the ship.

5 Claims, 8 Drawing Figures

APPARATUS AND METHOD FOR SELECTIVELY SUPPORTING, CONVEYING AND MOUNTING A PROPELLER AND RUDDER

BACKGROUND OF THE INVENTION

The present invention relates to an apparatus whereby a propeller and rudder which are to be attached to the body of a large ship in the dock of a shipyard are selectively conveyed to and mounted in their mounting positions at the stern of the ship. More particularly, the invention relates to a propeller and rudder supporting, conveying and mounting apparatus wherein a propeller supporting structure and a rudder supporting structure are provided on a pair of scaffolds mounted upright on an upper frame member, whereby the various jacks mounted on the upper and lower frame members are suitably operated while a propeller or rudder is being supported on the associated supporting structure and the part is conveyed to and mounted in its mounting position.

While apparatus has heretofore been proposed which is generally used in conveying and mounting a propeller or rudder in its mounting position at the stern of a ship during the building of the ship in the dock of a shipyard, this apparatus is designed to convey only either propellers or rudders with the result that two separate apparatus are needed for conveying both a propeller and rudder. Thus, there is a disadvantage that it is impossible to use such separate apparatus in a dock, or the like, where only a limited space is available and it is thus necessary to provide a dock having a large space which permits the movement of such apparatus with sufficient room. Another disadvantage is that the movement of the conventional apparatus itself requires the laying of rails or the like and hence it is impossible to use the conventional apparatus as such in the existing docks. With recently constructed ships becoming increasingly large in size with corresponding increase in the size and weight of their propellers and rudders, the conveyance and mounting of such propellers and rudders are now very difficult presenting difficult problems which must be solved urgently.

SUMMARY OF THE INVENTION

With a view to overcoming the foregoing difficulty, it is an object of the present invention to provide an improved apparatus which is well suited for supporting, conveying and attaching propellers as well as rudders to ships.

In accomplishing these and other equally desirable objects, the improved apparatus provided according to this invention has among its advantages the fact that it constitutes a conveyance equipment so designed that after a propeller or rudder has been externally brought into a dock and received by the apparatus, with the propeller or rudder supported by the apparatus, the apparatus is capable of travelling to its destination within the limited dock steering clear of places where there are obstacles and without the need for rails or the like.

A further advantage of the apparatus of this invention is that after a propeller or rudder has been conveyed to its destination and it has been adjusted by the apparatus to the desired position and height in relation to the body of a ship under construction or repair, the propeller or rudder can be held in position or it can be subjected to some fine adjustments by apparatus thus making it possible to easily attach the propeller or rudder to the body of the ship under construction or repair thereby considerably reducing the time required for these operations with corresponding reduction in the costs of these operations.

BRIEF DESCRIPTION OF THE PREFERRED EMBODIMENT

The invention will now be described in greater detail with reference to the illustrated embodiment.

Figure 1:
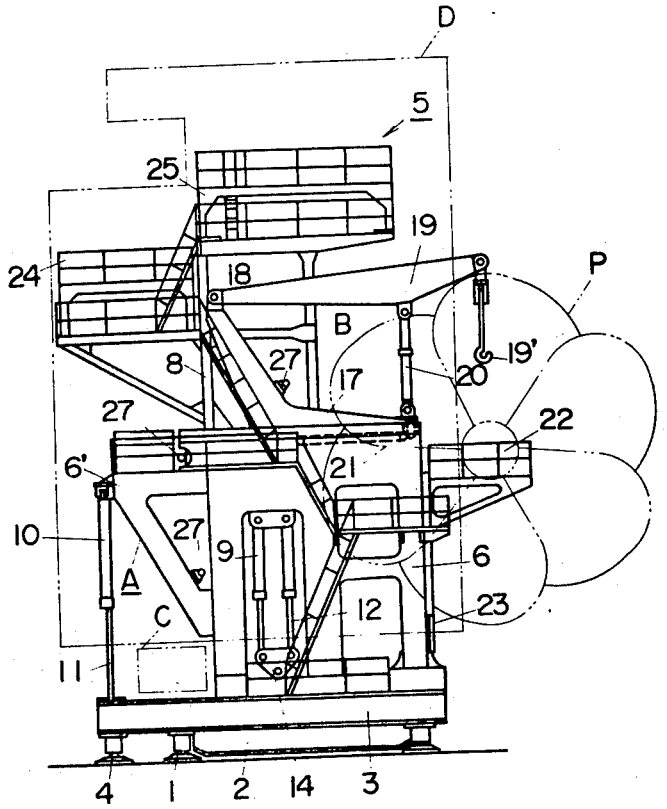
FIG. 1 is a front view of an apparatus according to this invention.
Figure 2:
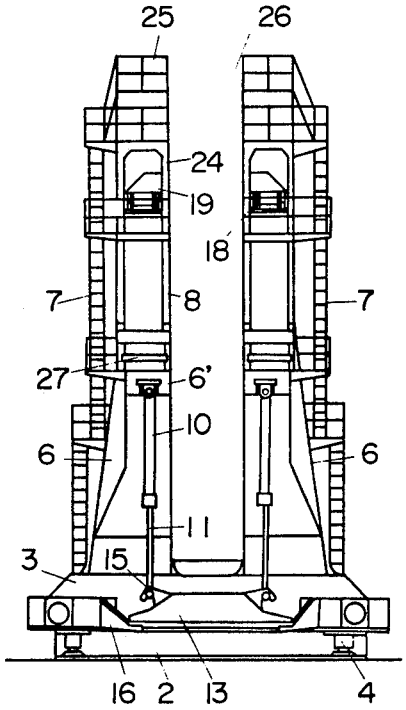
FIG. 2 is a left side view of the apparatus of FIG. 1.
Figure 3:
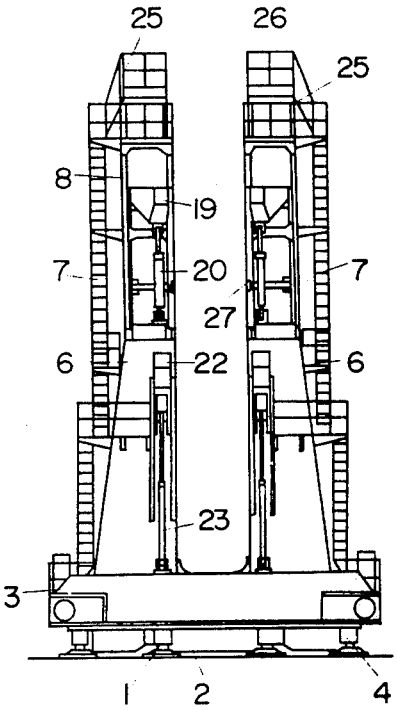
FIG. 3 is a right side view of the apparatus of FIG. 1.

Referring first to FIGS. 1 to 3 showing front and side views of the apparatus of this invention, the apparatus includes a lower frame member 2 with a jack 1 mounted at each of four positions thereof and an upper frame member 3 connected to the lower frame member 2 which is similarly provided with four jacks 4. The jacks 1 and 4 are separately operable to extend and contract so that when the jacks 4 are extended, the lower frame member 2 is raised along with the upper frame member 3 and in its relative position with the upper frame member 3 the lower frame member 2 can freely make a traverse movement as well as a turning movement. A pair of right and left support members 6 are mounted upright on the upper frame member 3 and work stages 24 and 25 are provided on the support members 6 by means of props 8 thus providing a pair of right and left scaffolds 5 by means of the support members 6, the props 8, etc. Each of the scaffolds 5 is provided with a number of ladders 7 to permit the operatives to go up and down through the ladders 7.

Arranged below the support members 6 is a rudder supporting and conveying structure A and a propeller supporting and conveying structure B is arranged on the support members 6. Thus, by selectively operating the structures A and B, it is possible to support, convey and mount a propeller P and rudder D in the proper position on the ship.

The rudder supporting and conveying structure A includes jacks 9 and 10 and a holding member 13. The jacks 9 are attached to the top part of each support member 6 to extend downward therefrom and their rods 12 are connected to a holding member 14, while each of the jacks 10 is attached to the end of a reinforcement 6' to depend therefrom and its rod 11 is detachably connected to each hook 15 of the holding member 13. The holding members 13 and 14 are arranged in the central portion of the upper frame member 3 so that the holding members 13 and 14 can be moved vertically by means of the jacks 9 and 10 with a rudder being supported thereon.

The holding member 13 is designed so that when the rudder D is to be attached to the stern of a ship, the holding member 13 can be moved past a lower gudgeon C in the stern, but it cannot be moved back passing below the lower gudgeon C after the rudder D has been mounted in position. To overcome this difficulty, the lower ends of the rods 11 are adapted to be detachable with the holding member 13 having the hooks 15 so that after the rudder D has been mounted in position, the rods 11 are temporarily disengaged with the holding member 13 by means of the hooks 15 and then the holding member 13 is placed on supports 16 mounted on the upper frame member 3 thereby permitting the withdrawal of the apparatus from the rudder mounting work position.

The propeller supporting and conveying structure B includes a pair of brackets 17 and a pair of arms 19. The brackets 17 are set up on the upper ends of the support members 6 and the arms 19 with propeller holding hooks 19' are extended to the right (in FIG. 1) from top pivot portions 18 of the brackets 17.

Disposed between the bracket 17 and the arm 19 is a jack 20 for adjusting the raised position of the propeller P and the brackets 17 are respectively provided with a jack 21 having its one end secured to the support member 6 and adapted to laterally move the bracket 17. Thus, by operating the jacks 20 adapted to adjust the height of the propeller P, the arms 19 can be vertically pivoted about the pivot portions 18 of the brackets 17 so as to adjust the height of the propeller P, while the jacks 21 mounted on the brackets 17 may be operated to laterally move the brackets 17 and the arms 19 and thereby to adjust the lateral position of the propeller P. The scaffolds 5 are respectively provided on its right side end (in FIG. 1) with a work stage 22 for positioning the propeller in relation to the propeller drive shaft at the stern and accomplishing its attachment to the stern and the work stages 22 are respectively vertically movable by means of a jack 23 disposed between the stage 22 and the upper frame member 3.

On the other hand, the work stages 24 are respectively provided with a control panel for controlling the various jacks and the height of the stages 25 is adjustable to suit the size of propellers.

The scaffolds 5 define therebetween a space portion 26 into which the propeller P or rudder D is insertable and a plurality of clamping devices 27 are mounted in the proper positions on the scaffolds 5 so as to prevent any shifting of the propeller P or rudder D from its position due to vibrations, etc., during its conveyance.

Figure 4:
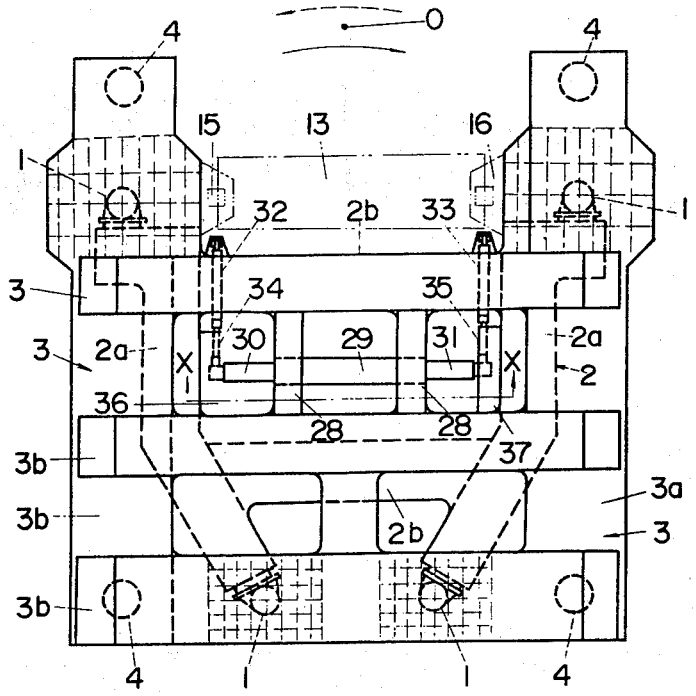
FIG. 4 is a plan view of the upper and lower frame members used in the apparatus of FIG. 1.
Figure 5:
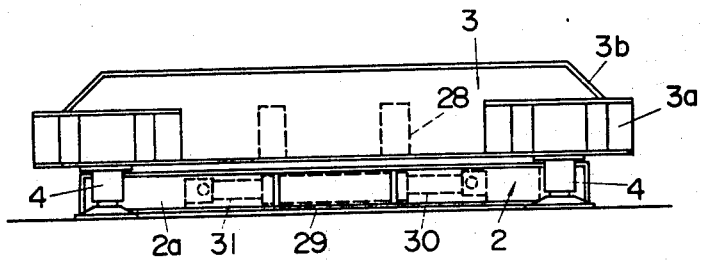
FIG. 5 is a rear side view of FIG. 4.
Figure 6:
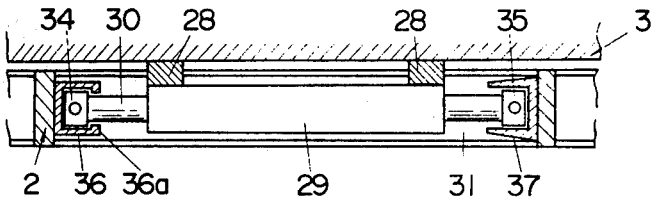
FIG. 6 is a sectional view taken along line X—X in FIG. 4.
Figure 7:
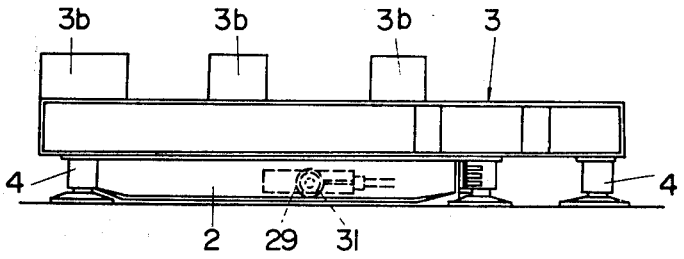
FIG. 7 is a side view of FIG. 4.
Figure 8:
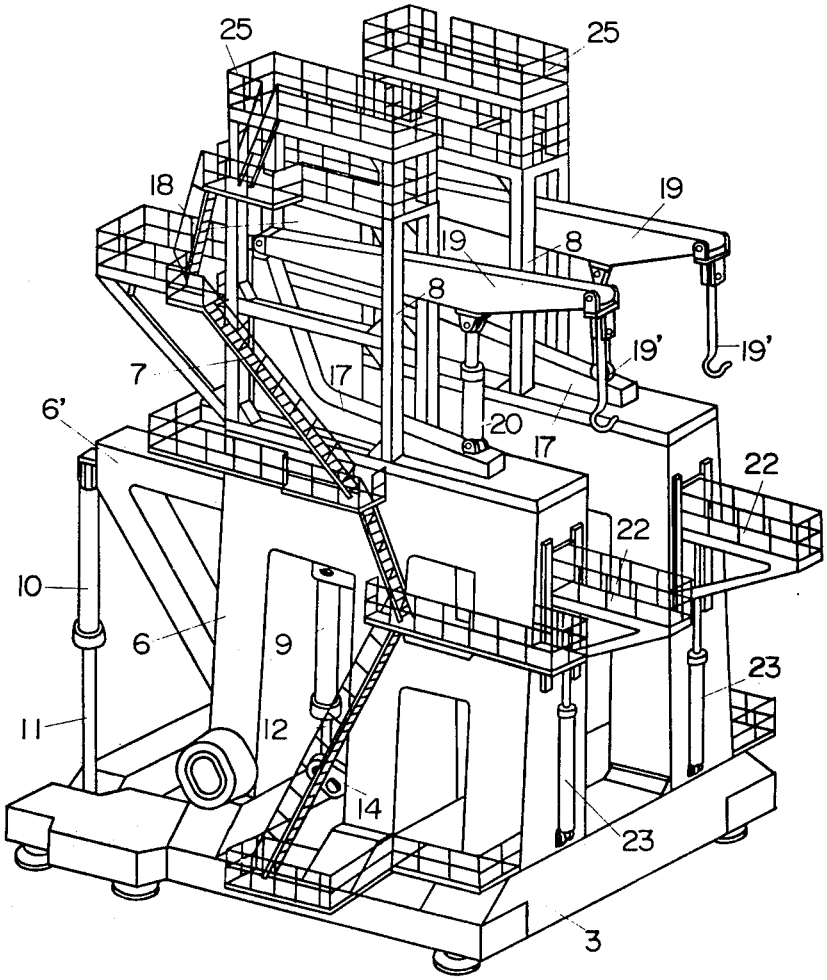
FIG. 8 is a general perspective view of the apparatus of this invention.

The lower and upper frame members 2 and 3 with the scaffolds 5 erected thereon will now be described in greater detail with reference to FIGS. 4, 5 and 6. The lower frame member 2 which is supported by the four jacks 1 comprise longitudinal beams **2*a* and cross beams 2*b* and the upper frame member 3 is placed on the lower frame member 2 to embrace the latter. The upper frame member 3 is similarly supported by the four jacks 4.**

The upper frame member 3 includes a pair of brackets 28 which are downwardly extended from the proper positions on the bottom surface thereof and a double rod jack 29 adapted to move the scaffolds 5 laterally (in FIG. 4) is connected to the brackets 28. The double rod jack 29 is horizontally positioned and its two rods 30 and 31 which extend in both directions have their forward ends respectively supported in guide pieces 36 and 37 of the lower frame member 2. Two jacks 32 and 33 which control the endwise and turning movements of the scaffolds 5 are additionally connected to the lower frame member 2 and arranged longitudinally and the forward ends of rods 34 and 35 of the jacks 32 and 33 are respectively connected to the rods 30 and 31 of the jack 29. With the connections between the rods 30 and 31 of the jack 29 and the rods 34 and 35 of the jacks 32 and 33, as will be seen from FIG. 6, the joint between the rod 30 of the double rod jack 29 and the rod 34 of the jack 32 is slidable within the guide piece 36 provided in the lower frame member 2 and the guide piece 36 has its forward ends bent inwardly to prevent the joint from getting out of the guide piece 36. The other joint between the rods 31 and 35 is similarly slidable within the guide piece 37, but the guide face of the guide piece 37 has a sufficient dimension to provide the maximum turning angle of the turning movement jack 33 and thereby to permit the turning movement of the scaffolds 5. Further, in order to ensure smooth movement of the lower and upper frame members 2 and 3 by the double rod jack 29 and the turning movement jacks 32 and 33, the jacks 1 mounted on the lower frame member 2 have their heads coated with a low friction material and the bottom of the upper frame member 3 which slidingly contacts with the heads of the jacks 1 is covered with stainless steel or the like.

Next, the operation of moving the lower and upper frame members 2 and 3 will be described. When it is desired to move the lower and upper frame members 2 and 3 laterally in FIG. 4, the jacks 4 mounted on the upper frame member 3 are extended first. When this occurs, the lower frame member 2 is raised from the road surface along with the raising of the upper frame member 3 by means of the double rod jack 29 connected to the brackets 28 depending from the upper frame member 3 and the guide pieces 36 and 37. In this condition, if working pressure oil is supplied to one side of the double rod jack 29 from a pump (not shown), the one rod 30 is extended and the other rod 31 is contracted, for example, thus moving the lower frame member 2 to the left in FIG. 4. After the lower frame member 2 has been laterally moved to its final position in this way, the jacks 4 mounted on the upper frame member 3 are contracted bringing the jacks 4 into contact with the ground along with the jacks 1 of the lower frame member 2. When this occurs, the jacks 1 on the lower frame member 2 are extended to raise the upper frame member 3 with the scaffolds 5 and then working pressure oil is supplied to the other side of the double rod jack 29. Consequently, the rods 30 and 31 are operated in the reverse directions to those mentioned earlier so that the rod 31 is extended and the rod 30 is contracted. However, since at this time the lower frame member 2 is held stationary by the jacks 1, the extension of the rod 31 now results in the movement of the body of the jack 29 to the left. As a result, through the intermediary of the brackets 28 connected to the double rod jack 29, the upper frame member 3 is moved to the left up to the position of the lower frame member 2 while maintaining a sliding contact between the stainless steel portions on its bottom surface and the low friction material applied on the heads of the jacks 1 supporting the lower frame member 2. This movement is repeated to have the apparatus walk to the destination. When it is desired to move the scaffolds 5 to the right, it is necessary to operate the jack 29 in the manner which is reverse to that mentioned so far.

Where the scaffolds 5 are to be moved in the endwise direction (in FIG. 4), as for example, when it is desired to move them backward, in the similar manner as mentioned previously, the jacks 4 mounted on the upper frame member 3 are extended to raise the lower frame member 2 from the ground and then working pressure oil is simultaneously supplied to the turning and endwise movement jacks 32 and 33 thus extending the rods 34 and 35 mounted in the jacks 32 and 33. When this occurs, the double rod jack 29 which is integrally connected with the rods 34 and 35 through the rods 30 and 31 is forced forward, but the jack 29 is held stationary since it is fixed to the upper frame member 3 by means of the brackets 28. Consequently, the lower frame member 2 is moved backward in an amount corresponding to the full stroke of the jacks 32 and 33. After the lower frame member 2 has been moved backward in this way, the jacks 4 on the upper frame member 3 are contracted and the jacks 1 on the lower frame member 2 are extended to support the upper frame member 3 with the scaffolds 5. Thereafter, working pressure oil is supplied to the other ends of the turning and endwise movement jacks 32 and 33 so that the rods 34 and 35 of the jacks 32 and 33 are contracted and the double rod jack 29 is pulled backward thus moving the upper frame member 3 backward through the brackets 28 connected to the double rod jack 29. When it is desired to move the scaffolds 5 forward, it is necessary to operate the jacks 32 and 33 in the manner which is reverse to that mentioned previously.

As described hereinabove, by repeatedly operating the jacks 1 and 4 mounted on the lower and upper frame members 2 and 3, the double rod jack 29 for controlling lateral movement and the jacks 32 and 33 for controlling turning and endwise movements, the apparatus can be moved endwise as well as sidewise up to the destination without the provision of rails.

As regards the turning movement of the lower and upper frame members 2 and 3, when it is desired to turn the lower and upper frame members 2 and 3 in the direction of a dotted line arrow O, the turning and endwise movement jack 32 is extended and the other jack 32 is contracted, whereas when it is desired to turn the lower and upper frame members 2 and 3 in the direction of the solid line, it is necessary to contract the jack 32 and extend the jack 33. In this case, in the same manner as mentioned previously, the jacks 4 on the upper frame member 3 must be first operated to raise the lower frame member 2 from the ground and after the completion of the turning movement of the lower frame member 2 the upper frame member 3 must be lowered and supported by the jacks 1 of the lower frame member 2.

The operation of mounting and conveying the propeller P as well as the rudder D by utilizing the scaffolds 5 on the lower and upper frame member 2 and 3 will now be described.

Firstly, when the propeller P is to be held in place on the propeller supporting structure B which is provided on the scaffolds 5, the propeller P which has been brought into a position above the apparatus by a crane or the like is lowered into the space portion 26 defined centrally between the scaffolds 5 and it is transferred from the crane to the apparatus by hanging the hub of the propeller by the wire ropes suspended from the hooks 19' which are extended downward from the forward ends of the arms 19. To place the thus transferred propeller P in a position aligned with the stern shaft, the arms 19 are vertically pivoted about the forward pivot portions 18 of the brackets 17 by means of the jacks 20 thus determining the correct height of the propeller hub and then the lateral movement jacks 21 are operated to determine the correct lateral position of the propeller hub. Thereafter, the propeller P which is now supported by the arms 19 is conveyed toward the stern while suitably controlling the operation of the lateral movement double rod jack 29 and the turning and endwise movement jacks 32 and 33 which are mounted on the lower and upper frame members 2 and 3. After the propeller supported by the propeller supporting structure on the scaffolds 5 has been brought near the propeller shaft (not shown) attached to the stern, the operatives get on the propeller mounting work stages 22 and the stages 22 are raised to near the propeller shaft by the jacks 23. Then, the propeller is fitted on the propeller shaft or drive shaft in the stern by means of the jacks 32 and 33, while adjusting the position of the arms 19 and the brackets 17 by means of the jacks 20 and 21 thus completing the mounting of the propeller P on the propeller shaft.

When the mounting of the propeller P has been completed in the manner described above, the lower and upper frame members 2 and 3 are again moved and returned back into the initial position. When this occurs, the rudder D is similarly brought above the apparatus by the crane and then it is lowered into the space portion 26 centrally defined between the scaffolds 5. After the rudder D has been placed on the rudder holding member 13 of the rudder supporting structure A, the holding member 13 is raised by the jacks 9 and 10 to a position which permits it to pass over the lower gudgeon C in the stern and then the plurality of the clamp devices 27 disposed on the scaffolds 5 are extended to firmly hold the rudder D in place thus preventing the rudder D from being shifted during its conveyance due to vibrations, etc. When the rudder has been completely supported by the rudder supporting structure A provided on the scaffolds 5, in the similar manner as the movement of the propeller, the lower and upper frame members 2 and 3 carrying the scaffolds 5 thereon are moved toward the stern by suitably operating the jacks 29, 32 and 33 which are mounted on the frame members 2 and 3. When the pintle attached to the rudder D is brought into a position above the hole formed in the lower gudgeon C, the clamp devices 27 holding the rudder D are contracted to release the clamping of the rudder D. Then, the jacks 9 and 10, supporting the rudder D are extended and at the instant that the pintle is inserted into the hole formed in the lower gudgeon C the rudder post is attached to the rudder to support it. Thereafter, the rudder holding member 13 which is supported by the jacks 10 attached to the ends of the scaffolds 5, is placed on the holding pieces 16 attached to the upper frame member 3 and the rods 11 extended from the jacks 10 are disengaged with the hooks 15 of the rudder holding member 13. Then, the jacks 10 are contracted so as to prevent the rudder holding member 13 from interferring with the lower gudgeon C during its return movement and then the scaffolds 5 are returned to the intial position by the same means as mentioned previously.

It will thus be seen from the foregoing description that with the apparatus of this invention, both the propeller P and the rudder D can be attached to the stern by means of a single propeller and rudder mounting apparatus and moreover the apparatus can be conveyed to its destination without providing rails or the like which are required by the conventional apparatus, but by suitably selectively operating the jacks 1 and 4 mounted on the lower and upper frame members 2 and 3 as well as the lateral movement controlling double rod jack 29 and the turning and endwise movement controlling jacks 32 and 33 which are provided between the frame members, thus making it possible to easily convey to and mount a propeller as well as a rudder in its mounting position. Thus, the present invention has a great utility.

While the apparatus of this invention has been described as usable to selectively convey and mount both propellers and rudders, the apparatus of this invention can be used exclusively for conveying and mounting either propellers or rudders as the case may be without any diminution of its industrial utility value.

Further, while the apparatus of this invention has been described as used for supporting, conveying and mounting a propeller as well as a rudder to a ship under construction, it is of course possible to use the apparatus of this invention to remove the propeller as well as the rudder of a ship docked for repair in the manner reverse to that of the above-mentioned mounting operation.

What is claimed:

1. A propeller and rudder supporting, conveying and mounting apparatus comprising a frame including a conveying structure, a scaffold mounted on said frame, and mounting means mounted on said scaffold for selectively supporting a propeller and a rudder and mounting the same in a predetermined position, said frame means comprising an upper frame member and a lower frame member, each including four jacks mounted thereon, a double-rod jack connected to said upper frame member on the underside thereof and including two rods extending from said jack and supported at their ends by the lower frame member; said lower frame member including two jacks for turning and moving the lower frame member back and forth, said two jacks including two rods connected to said two rods of said double-rod jack; sliding contact means between said two frame members; and a pair of scaffolds erected on the frame means and having a space therebetween to selectively accommodate a propeller and a rudder; said mounting means comprising fine adjustment means mounted on said scaffolds respectively for lifting, lowering and positioning the propeller and rudder.

2. An apparatus according to claim 1, wherein said mounting means includes a plurality of pairs of jacks on said scaffolds for mounting said rudder, holding means with hooks for directly carrying the weight of said rudder, at least one pair of jacks of said plurality of pairs of jacks including rods having forward ends detachably engageable with associated hooks.

3. An apparatus according to claim 2, wherein each of said scaffolds includes means for varying the height of a work stage in accordance with the size of the propeller or rudder to be mounted.

4. Apparatus according to claim 1, wherein said mounting means comprises a pair of brackets mounted on said scaffolds and a pair of arms swingably supported at one end by said brackets, each arm including a hook at the other end for supporting a propeller and including an intermediate jack for adjusting the height of the propeller.

5. A method of selectively supporting a propeller and a rudder and for mounting the same in a predetermined position by a scaffold erected on a conveyable frame structure, comprising the steps of: supporting the rudder by a plurality of pairs of jacks for handling the same and carrying the rudder higher than a lower gudgeon; conveying the rudder to a position where the pintle of the rudder is fittable in a bore of the lower gudgeon; and after said pintle is fitted in said bore, disengaging both ends of holding means supporting the rudder from the jacks thereby permitting the support for the propeller and rudder to move away from the position for the mounting operation.

* * * * *